United States Patent [19]

Maina

[11] Patent Number: 4,949,763

[45] Date of Patent: Aug. 21, 1990

[54] DEVICE FOR DAMPING WEFT YARN OSCILLATIONS AND VIBRATIONS IN WEFT FEEDERS FOR AIR LOOMS

[75] Inventor: Bruno Maina, Vercelli, Italy

[73] Assignee: ROJ Electrotex S.p.A., Biella, Italy

[21] Appl. No.: 28,338

[22] Filed: Mar. 23, 1987

[51] Int. Cl.[5] ..... D03D 47/36

[52] U.S. Cl. ..... 139/452; 139/450

[58] Field of Search ..... 139/429, 435, 450, 452

[56] References Cited

U.S. PATENT DOCUMENTS

| | | | |
|---|---|---|---|
| 3,378,040 | 4/1968 | Moessinger | 139/450 |
| 3,416,572 | 12/1968 | Giavini | 139/450 |
| 4,458,729 | 7/1984 | Brouwer et al. | 139/435 |

FOREIGN PATENT DOCUMENTS

| | | | |
|---|---|---|---|
| 155431 | 9/1985 | European Pat. Off. | 139/450 |

*Primary Examiner*—Andrew M. Falik

*Attorney, Agent, or Firm*—Young & Thompson

[57] ABSTRACT

A device for greatly damping the oscillations and vibrations of weft yarns fed from a weft feeder to a loom, at the outlet of the feeder, particularly when yarn cutting takes place in the loom, comprises, in association with the conventional fixed yarn guide at the outlet of the weft feeder, a second fixed yarn guide, parallel to the first and downstream thereof, as well as an intermediate yarn guide, movable between a position in which it does not engage the weft yarn on its path between the two guides, and a position in which it engages the yarn and deviates it, forcing it to follow a winding path between the two guides. The positions of the intermediate yarn guide are controlled by an actuator and selected by the electronic circuit of the weft feeder, according to the working of the loom, so as to deviate the yarn when yarn cutting takes place.

3 Claims, 2 Drawing Sheets

DEVICE FOR DAMPING WEFT YARN OSCILLATIONS AND VIBRATIONS IN WEFT FEEDERS FOR AIR LOOMS

BACKGROUND OF THE INVENTION

It is known that, among the weft feeders for looms, there are some—particularly used for jet looms—which measure predetermined weft yarn lengths by means of optical units. Usually, said devices (called "measuring weft feeders") also provide to stop the measured weft yarn lengths by means of magnets, whose cores block the weft yarn in correspondence of the conical end of the drum around which the yarn reserve is wound. A particularly efficient device of this type is that described in the Italian Patent Application No. 20307 A/83 of the same Applicant, to which reference is made for fuller details.

In devices of the type mentioned heretofore—and particularly in that of the cited Italian Application—the magnets positively guarantee the stopping of the measured yarn when said yarn is under tension (which is of course a very slight tension). However, according to the Applicant's most recent experiments, this condition is not always fulfilled; in fact, during operation of the loom and of the weft feeder applied thereon, there are times and circumstances in which even the slightest weft yarn tension, required for the proper working of the device, is missing.

It has actually been established that the condition of slightly tensioned weft yarn is usually fulfilled while the weft is being inserted in the loom, in that the air jets from the main and secondary nozzles are apt to supply said tension. Whereas, a very delicate step of the weft insertion in a jet loom, is when the yarn is being cut by the cutting devices positioned at the outlet of the main nozzle.

Referring to FIG. 1 of the accompanying drawings—which schematically shows the weft insertion steps in a jet loom—it can be seen that the weft is drawn by the measuring weft feeder 1 and is inserted into the shed thanks to the main nozzle 2, which is positioned on the loom sley, aligned with the reed and movable therewith.

Weft insertion practically starts in the position A, in which the reed is fully open, and it ends about half way between said position and the position B, in which the reed is fully closed (reed beat-up position). As known, the end of the insertion corresponds to the measuring of the unwound weft yarn, that is, to the blocking of the yarn by the movable body of the energized magnet. Subsequently, close to the reed beat-up position, the weft yarn is cut by the cutter F positioned between the main nozzle 2 and the reed P and movable therewith.

As can be seen from FIG. 1, in order to obtain short insertion times, the yarn guide at the outlet of the measuring weft feeder should be more or less aligned with the reed in position A (fully open reed), in order to prevent tensions on the yarn deriving from friction on the yarn guides. When cutting takes place, with the reed in position B (fully closed reed), the weft yarn is under tension along the stretch between the outlet of the measuring weft feeder and the fabric being woven, in that it is blocked at these two ends slightly before the reed reaches the beat-up position B.

The weft is in fact blocked in the weft feeder thanks to the magnet, and in the loom thanks to the closing of the shed.

The excess of tension on the weft is thus determined by the longer path it has to follow from the moment in which it gets blocked at the ends to the moment in which it gets cut. When cutting takes place, there is a sudden fall in the tension which causes oscillations along the stretched weft yarn, said oscillations travelling from the cut end of the yarn up to the yarn guide at the outlet of the weft feeder, and into said feeder, up to involving the yarn turns wound on the drum.

These oscillations—which turn into strong transversed and longitudinal waves—prevent the weft yarn from being slightly tensioned during the aforementioned working step, in which the yarn is instead subjected to strong oscillations; this could easily lead the yarn to be wedged under the magnet pin even after having stopped against said pin.

This behavior determines a wrong measuring of the inserted weft yarn, with errors which can take up different aspects, but all of which are always dangerous.

Usually, a yarn turn passes under the magnet pin (in special cases, it can be more turns) after the weft has been inserted, with the result that—in the case of working with a single-colored loom—one finds oneself in the presence of a yarn length longer by a turn in the next insertion, and—in the case of working with a multi-colored loom—one may be faced with the simultaneous insertion of two turns of different-colored yarn.

This phenomenon—which takes place especially in the case of scarcely elastic yarns, wherein the effect produced by the sudden fall of tension cannot be absorbed by the elasticity of the yarn—is particularly harmful in the case of working with a multi-colored loom, in that it can occur on changing of the color, and it will appear as an insertion corresponding to one or more turns, simultaneously with the next color and in the same shed, which cannot be detected by the weft control systems used at present on jet looms.

It has already been observed that these drawbacks are reduced, up to almost disappearing, if the measuring weft feeder is positioned in respect of the loom so as to always produce a friction on the outlet yarn guide, or else if a similar friction is produced on a guide or bar, apt to deviate the yarn, being positioned between the outlet of the weft feeder and the inlet of the main nozzle. This arrangement would however involve such long insertion times as to be unacceptable, whereby, up to the present, no solution has yet been found to the problem of preventing, during the cutting step, weft yarn oscillations from travelling up beyond the outlet yarn guide, into the weft feeder, without varying the loom insertion times.

SUMMARY OF THE INVENTION

The present invention faces and solves this problem in a simple and efficient manner, starting from the concept that weft yarn friction on the yarn guide has above all the function to stop weft yarn oscillations and vibrations towards the weft feeder, soon after cutting has taken place, but also taking into account the fact that, in order not to affect the insertion times, it is necessary to produce said friction only for a short time, when cutting takes place.

To reach this object, the present invention supplies a device apt to greatly dampen the oscillations and vibrations of weft yarns fed from a weft feeder to a loom, at the outlet of said feeder, particularly when yarn cutting takes place in the loom, said device being characterized in that it comprises, in association with the conventional fixed yarn guide at the outlet of the weft feeder, a second fixed yarn guide, parallel to the first and downstream thereof, as well as an intermediate yarn guide, movable between a position in which it does not engage the weft yarn on its path between the two guides, and a position in which it engages said yarn and deviates it, forcing it to follow a winding path between said two guides, and in that said positions of the intermediate yarn guide are controlled by an actuator and selected by the electronic circuit of the weft feeder, according to the working of the loom, so as to deviate said yarn when yarn cutting takes place.

Said movable intermediate yarn guide preferably consists of an eyelet, though it could equally well consist of a bar. In the event of said movable intermediate yarn guide consisting of an eyelet, this latter is in alignment with the two fixed yarn guides, in the first position, and offset in respect of said fixed yarn guides, in the second position.

BRIEF DESCRIPTION OF THE DRAWINGS

The invention is now described in further detail, by mere way of example, with reference to the accompanying drawings, in which.

DESCRIPTION OF THE PREFERRED EMBODIMENT

Figure 1:
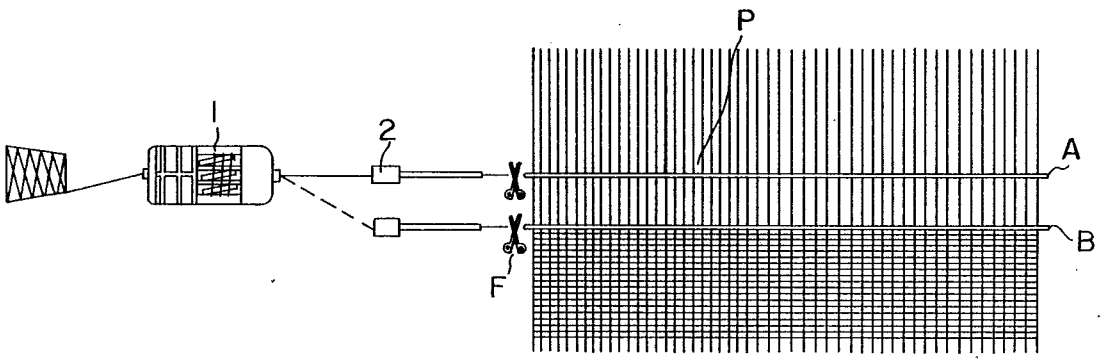
FIG. 1, as already seen, diagrammatically illustrates the weft yarn insertion steps in a jet loom.
Figure 2:
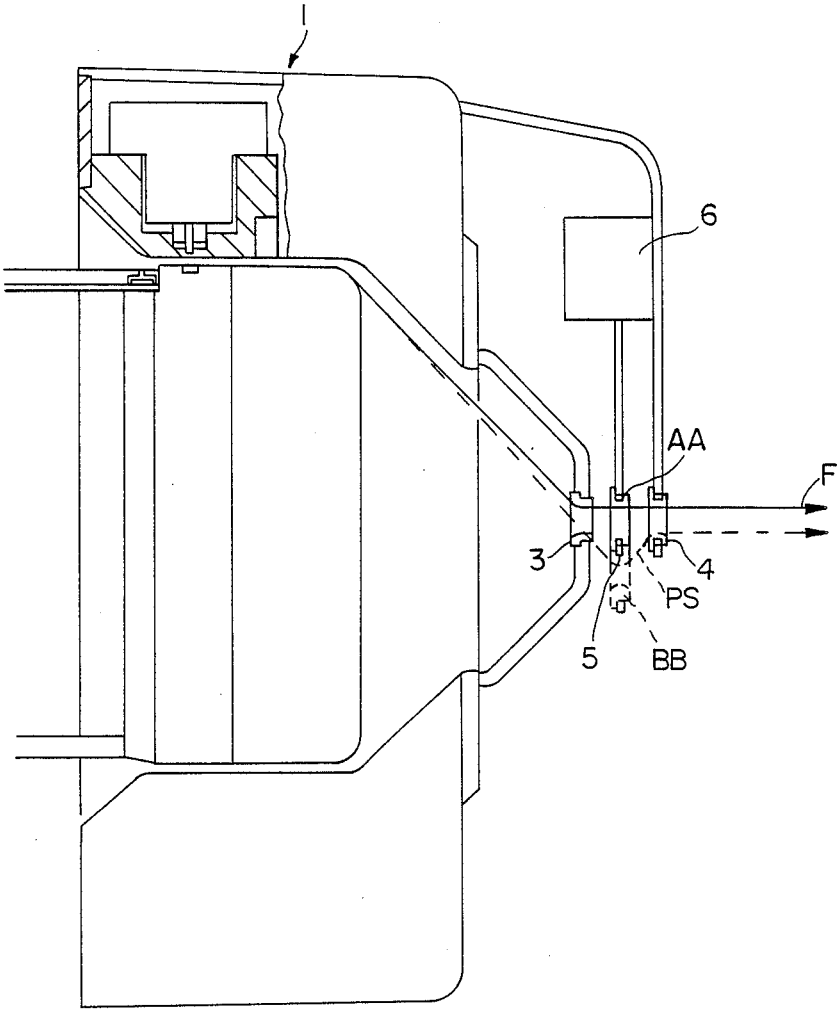
FIG. 2 illustrates the damping device according to the invention, applied at the outlet end of a measuring weft feeder.

As shown in FIG. 2, close to the yarn guide 3 fixed to the body of a measuring weft feeder 1—of the type described in the introductory part of the present specification—there is positioned a second yarn guide 4, which is also fixed to the weft feeder 1, at a short distance from the first yarn guide.

A third yarn guide 5 (in the form of an eyelet, or of a simple bar) is provided between said two yarn guides 3 and 4, said yarn guide 5 being fixed to the movable part of an actuator 6 which allows it to take up two positions:

- a first position AA, in which the intermediate yarn guide 5 is aligned with the two yarn guides 3 and 4; and
- a second position BB, in which it is not aligned with said yarn guides.

The actuator 6—electromechanically or electropneumatically operated—is connected to the electronic control circuit of the weft feeder 1, which operate said actuator strictly according to the working of the loom to which the weft feeder is applied.

As can be seen from FIG. 2, when the actuator 6 disposes the yarn guide 5 in the aligned position AA, the weft yarn f is not subject to friction and deviations.

Viceversa, when the intermediate yarn guide 5 is disposed by the actuator 6 in the offset position BB, the weft yarn f is deviated to follow a winding path PS between the two yarn guides 3 and 4.

By connecting the actuator 6 to the control circuit of the weft feeder 1, it is possible to obtain the position BB of the yarn guide 5 only during the cutting step, that is, just as the weft yarn is cut by the loom cutting device.

In other words, the actuator 6 allows positioning the yarn guide 5 in the position AA throughout weft insertion, while shifting said yarn guide to the position BB after insertion (while cutting takes place) and shifting it back to the position AA before the next insertion starts.

It has been observed that the friction produced on the yarn f—as the yarn guide 5, controlled by the actuator 6, takes up the position BB, causing said yarn to deviate and to follow the winding path PS—is capable of greatly damping the weft yarn oscillations and vibrations resulting from the cutting operation, thereby stopping the yarn from passing under the magnet pin.

The object has thus been achieved to obtain a proper working of the measuring weft feeder; without having to resort to compromises between weft release (and thus, short insertion times) and weft deviations and friction (and thus, damping of the weft yarn oscillations and vibrations in particular working conditions of the loom).

FIG. 2 of course illlustrates only a constructive solution provided by way of example; as already mentioned, the movable yarn guide 5 could in fact consist, as well as of an eyelet (as shown on the drawing), also simply of a bar, or of any other element shaped so as to cause a deviation of the weft and impose a friction thereon.

A similar effect can also be obtained with a device controlled in the same manner which, instead of deviating the yarn, produces thereon a slight braking action, which is equally apt to dampen the weft yarn oscillations and vibrations produced by cutting.

I claim:

1. In a loom having a weft feeder for feeding yarn to the loom, a cutter for cutting off fed lengths of yarn, the weft feeder having an outlet and a fixed yarn guide at said outlet; the improvement comprising a second fixed yarn guide in alignment with the first yarn guide and spaced downstream thereof with respect to the direction of travel of yarn from the yarn guide outlet, an intermediate yarn guide movable from a first position in which it does not engage the weft yarn on its path between the two fixed guides and a position in which it engages said yarn and deflects the yarn, thereby forcing the yarn to follow a winding path between said two fixed guides, and an actuator that moves said intermediate yarn guide from said first position to said second position and back to said first position just at the time of actuation of said cutter, thereby to damp weft yarn oscillations and vibrations resulting from operation of said cutter.

2. Apparatus as claimed in claim 1, wherein said intermediate yarn guide is an eyelet.

3. Apparatus as claimed in claim 2, in which said fixed yarn guides are eyelets and said intermediate yarn guide eyelet is in alignment with said fixed yarn guide eyelets in said first position and out of alignment with said fixed yarn guide eyelets in said second position.

* * * * *